United States Patent [19]

Mount et al.

[11] 4,219,305

[45] Aug. 26, 1980

[54] DIFFUSER CONTROL

[75] Inventors: Gordon L. Mount, W. Monroe; Howard W. Kirtland, N. Syracuse, both of N.Y.

[73] Assignee: Carrier Corporation, Syracuse, N.Y.

[21] Appl. No.: 973,405

[22] Filed: Dec. 26, 1978

[51] Int. Cl.[2] ..... F04D 27/02; F04D 29/46

[52] U.S. Cl. ..... 415/13; 415/48; 415/148; 415/158

[58] Field of Search ..... 415/26, 46, 47, 48, 415/49, 148, 150, 157, 158, 113

[56] References Cited

U.S. PATENT DOCUMENTS

| | | | |
|---|---|---|---|
| 916,427 | 3/1909 | Fee | 415/26 |
| 2,957,424 | 10/1960 | Brundage | 415/48 |
| 3,032,259 | 5/1962 | Jassniker | 415/148 |
| 3,251,539 | 5/1966 | Wolfe et al. | 415/158 X |
| 3,289,919 | 12/1966 | Wood | 415/158 X |
| 3,362,624 | 1/1968 | Endress | 415/49 X |
| 3,362,625 | 1/1968 | Endress | 415/149 R |
| 3,365,120 | 1/1968 | Jassniker | 415/26 |
| 3,399,625 | 9/1968 | Skinner | 415/47 |
| 3,619,078 | 11/1971 | Mount et al. | 415/150 |
| 3,667,860 | 6/1972 | Endress et al. | 415/150 |
| 4,070,132 | 1/1978 | Lynch | 415/48 |

FOREIGN PATENT DOCUMENTS

| | | | |
|---|---|---|---|
| 305214 | of 1930 | United Kingdom | 415/158 |
| 753316 | 7/1956 | United Kingdom | 415/158 |
| 1445016 | 8/1976 | United Kingdom | 415/148 |

*Primary Examiner*—Leonard E. Smith

*Attorney, Agent, or Firm*—J. Raymond Curtin; John S. Sensny

[57] ABSTRACT

A diffuser control for controlling vapor flow through a diffuser passage comprising an annular recess defined by a housing of the passage and in communication therewith, a diffuser control ring supported for movement within the annular recess and the diffuser passage between a full throttling position, wherein the restriction means throttles vapor flow through the diffuser passage, and an open position for permitting a substantially free flow of vapor through the diffuser passage. The control further comprises a first set of springs for urging the control ring toward the full throttling position, and a second set of springs for urging the control ring toward an intermediate throttling position located between the open and full throttling positions. The diffuser control also comprises a low pressure conduit for connecting the annular recess to a low pressure source, and a intermediate pressure conduit for connecting the annular recess to an intermediate pressure source. Valves are provided for regulating vapor flow through the low pressure and intermediate pressure conduits, and include a first position for maintaining a low pressure in the annular recess for maintaining the control ring in the open position, a second position for maintaining an intermediate pressure in the annular recess for maintaining the control ring in the intermediate throttling position, and a third position for maintaining a high pressure in the annular recess wherein the first set of springs maintains the control ring in the full throttling position.

12 Claims, 3 Drawing Figures

DIFFUSER CONTROL

BACKGROUND OF THE INVENTION

This invention relates to centrifugal vapor compressors, and more particularly to controlling vapor flow through a diffuser passage of a centrifugal vapor compressor.

One of the major problems arising in the use of centrifugal vapor compressors for applications where the compressor load varies over a wide range is flow stabilization through the compressor. The compressor inlet, impeller and diffuser passages must be sized to provide for the maximum volumetric flow rate desired. When there is a low volumetric flow rate through such a compressor, the flow becomes unstable. As the volumetric flow rate is decreased from a stable range, a range of slightly unstable flow is entered. In this range, there appears to be a partial reversal of flow in the diffuser passage, creating noises and lowering the compressor efficiency. Below this range, the compressor enters what is known as surge, wherein there are periodic complete flow reversals in the diffuser passage, destroying the efficiency of the machine and endangering the integrity of the machine elements. Since a wide range of volumetric flow rates is desirable in many compressor applications, numerous modifications have been suggested to improve flow stability at low volumetric flow rates.

One of the most accepted and successful modifications has been the addition of guide vanes in the inlet of the compressor to vary the flow direction and quantity of entering vapor. Another widely known modification has been to vary diffuser configuration in response to the load on the compressor. Commonly, this is done by means of a diffuser control ring which moves laterally across the diffuser passage to throttle vapor flow therethrough. Prior art variable diffuser control rings have been generally controlled by a mechanism arranged to locate and hold the control ring at any position between a full open and a full closed position. Such control mechanisms are typically relatively expensive, often involving fairly complex mechanical and/or pneumatic components. Further, because of the complex components, the manufacture and installation of diffuser ring control mechanisms are often difficult and time consuming tasks requiring expensive skilled manual labor. While continuously variable diffuser control rings often provide excellent results, it has been learned that very satisfactory results can be achieved with a diffuser control ring which has a limited number of discrete, spaced throttling positions. While obtaining these very satisfactory results, a discretely variable diffuser control, in accordance with the present invention, is, at the same time, much simpler than prior art diffuser controls. This simplicity facilitates and reduces the cost of construction, installation, and maintenance of the diffuser control and improves the reliability thereof.

SUMMARY OF THE INVENTION

An object of this invention is to improve centrifugal vapor compressors, particularly diffuser controls thereof.

Another object of the present invention is to simplify the manufacture and installation of diffuser controls.

A further object of this invention is to provide a three position diffuser control.

A still further object of the present invention is to use compressor inlet pressure to maintain a diffuser control ring in an open position, and an intermediate pressure source to maintain the diffuser control ring in an intermediate position.

Another object of this invention is to vary a diffuser control of a centrifugal vapor compressor in response to position of inlet guide vanes thereof.

These and other objectives are attained with a diffuser control for controlling vapor flow through a diffuser passage comprising an annular recess defined by a housing of the passage and in communication therewith, and diffuser restriction means supported for movement within the annular recess and the diffuser passage between a full throttling position, wherein the restriction means throttles refrigerant vapor flow through the diffuser passage, and an open position for permitting a substantially free flow of vapor through the diffuser passage. The control further comprises first urging means for urging the diffuser restriction means toward the full throttling position, second urging means for urging the diffuser retriction means toward an intermediate throttling position located between the open and full throttling positions, and conduit means for connecting the annular recess to a low pressure source. Valve means is provided for regulating vapor flow through the conduit means and includes a first position for maintaining a low pressure in the annular recess for maintaining the restriction means in the open position, a second position for maintaining an intermediate pressure in the annular recess for maintaining the restriction means in the intermediate throttling position, and a third position for maintaining a high pressure in the annular recess wherein the first urging means maintains the restriction means in the full throttling position.

A BRIEF DESCRIPTION OF THE DRAWINGS

A DETAILED DESCRIPTION OF THE PREFERRED EMBODIMENT

Figure 1:
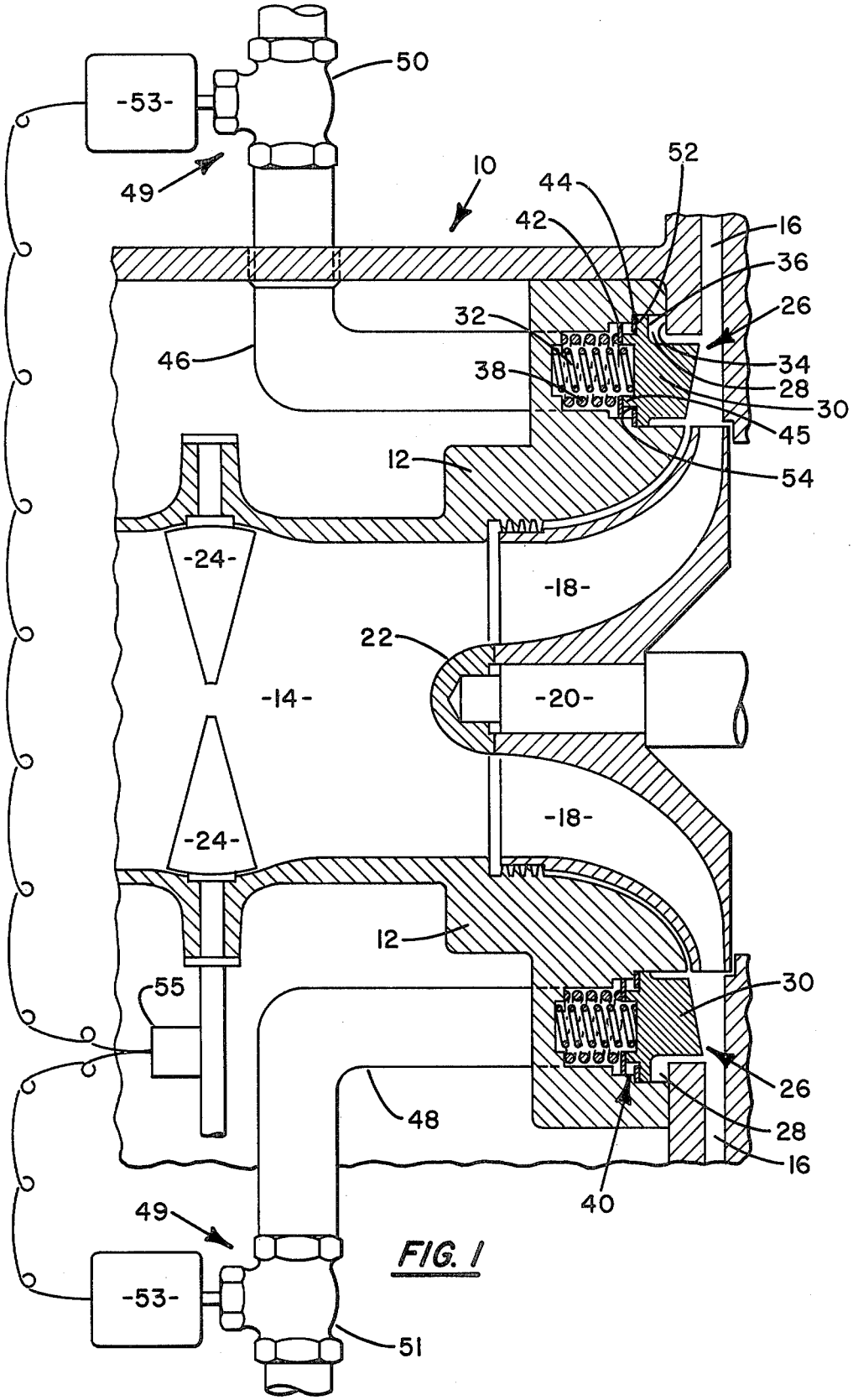
FIG. 1 is an elevational view, partly in section of a portion of a centrifugal compressor incorporating the teachings of the present invention and showing the diffuser control ring thereof in the open position.

Referring generally to the drawings, there is shown portions of vapor compressor 10 of the well-known centrifugal type wherein the vapor to be compressed is induced to flow in an axial direction into a vaned impeller connected to a suitable driver for imparting rotary motion thereto. As the vapor is compressed during its travel through the compressor, it is directed radially from the impeller to a diffuser passage communicating with the tip of the impeller. More particularly, compressor 10 includes housing 12 with inlet passage 14 and diffuser passage 16 formed therein. Only portions of housing 12 are shown, it being understood that such a construction is convertional in equipment of the kind under consideration. Impeller 18 affixed to shaft 20 by nut 22 is provided in housing 12 between inlet passage 14 and diffuser passage 16. Inlet guide vanes 24 journaled for rotation in housing 12 are positioned about inlet passage 14 to control the direction and quantity of vapor flow therethrough. Diffuser control, referenced generally as 26, is provided for controlling vapor flow through diffuser passage 16.

Diffuser control 26 comprises, generally, annular recess 28 defined by housing 12 and in communication with diffuser passage 16, and diffuser restriction means such as annular control ring 30. Control ring 30 is supported for movement within recess 28 and diffuser passage 16 between an open position, shown in FIG. 1, and a full throttling position, shown in FIG. 3. In the full throttling position, control ring 30 throttles vapor flow through diffuser passage 16; and, preferably, in the open position, the control ring allows an unrestricted flow of vapor through the diffuser passage. First urging means 32 supported by housing 12 is provided for urging control ring 30 toward the full throttling position. Preferably, the first urging means includes resilient means such as a plurality of springs 32 positioned within recess 28. Springs 32 are preferably equally spaced about the circumference of control ring 30, forming a ring of springs with a radius equal to that of the control ring. Stop means 34 limits movement of control ring 30 at the full throttling position for preventing the control ring from completely restricting vapor flow through diffuser passage 16. Preferably, stop means 34 includes a surface of housing 12. More specifically, as control ring 30 moves forward, from left to right as viewed in the drawings, and reaches the full throttling position, flange 36 of the control ring abuttingly engages surface 34 and this abutting contact prevents further forward movement of the control ring.

Figure 2:
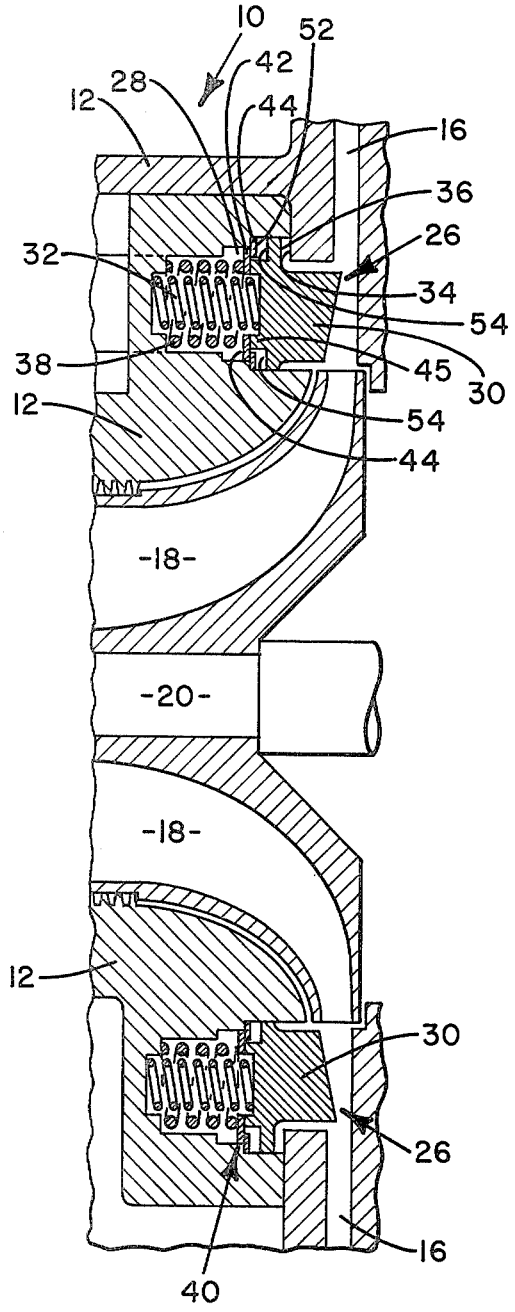
FIG. 2 shows portions of the compressor shown in FIG. 1 with the diffuser control ring in the intermediate throttling position.

Second urging means 38 supported by housing 12 is provided for urging control ring 30 toward an intermediate throttling position, shown in FIG. 2, between the open and full throttling positions. Preferably, the second urging means includes resilient means such as a plurality of springs 38 positioned within recess 28. Springs 38 are preferably equally spaced about the circumference of control ring 30, forming a second ring of springs with a radius also equal to that of the control ring. In the embodiment depicted in the drawings, springs 32 and 38 have a generally cylindrical shape, with each spring 38 concentrically encircling a spring 32. Force limiting means, referenced generally as 40, limits the force exerted by springs 38 on control ring 30 at the intermediate throttling position. In the illustrated embodiment, force limiting means 40 includes movable rings 42 and stop means such as stationary rings 44 which are secured to housing 12 and extend into annular recess 28. Rings 42 are slidably supported within recess 28 between springs 38 and fingers 45 of control ring 30. Springs 38 abuttingly engage rings 42, and this abutting contact maintains springs 38 to the left of the rings. Springs 32, however, are slidable within rings 42, and rings 42 do not interfere with movement of springs 32.

As control ring 30 moves between the open and intermediate throttling positions, rings 42 abuttingly engage and transmit force between springs 38 and the control ring. When control ring 30 is in the intermediate throttling position, as shown in FIG. 2, movable rings 42 abuttingly contact stationary rings 44. This contact prevents further movement of movable rings 42 to the right as viewed in the drawings. Control ring 30, though, is free to move further to the right and is urged so by springs 32. As control ring 30 moves forward between the intermediate throttling and full throttling positions, movable rings 42 and springs 38 become spaced from the control ring. When this occurs, force is not transmitted between springs 38 and control ring 30.

Diffuser control 26 further comprises conduit means including low pressure conduit 46 for connecting annular recess 28 with a low pressure source, for example an inlet line of compressor 10, and intermediate pressure conduit 48 for connecting the annular recess with an intermediate pressure source. For example, in case compressor 10 is a multi-stage compressor, the intermediate pressure source may be an intermediate stage of the compressor. Valve means 49 includes a first position for maintaining a low pressure in annular recess 28. This pressure is sufficiently lower than the pressure in diffuser passage 16 so that the pressure force on control ring 30 due to the pressure difference between annular recess 28 and the diffuser passage is greater than the force on control ring 30 due to springs 32 and 38. This first pressure force maintains control ring 30 in the open position. Preferably, when valve means 49 is in the first position, low pressure conduit 46 is open through operation of valve 50 and intermediate pressure conduit 48 is closed by valve 51. The low pressure source is chosen so that, when conduit 46 is open and conduit 48 is closed, the pressure in annular recess 28 is sufficiently low to accomplish the above-described result.

Valve means 49 also includes a second position for maintaining an intermediate pressure in recess 28. With this intermediate pressure, the pressure force on control ring 30 due to the pressure difference between annular recess 28 and diffuser passage 16 is less than the combined forces on the control ring due to springs 32 and 38 but more than the forces on the control ring due solely to springs 32. This second pressure force maintains control ring 30 in the intermediate throttling position. Preferably, when valve means 49 is in the second position, low pressure conduit 46 is closed by valve 50 and intermediate pressure conduit 48 is open through operation of valve 51. The intermediate pressure source is chosen so that, when conduit 46 is closed and conduit 48 is open, the pressure in annular recess 28 is sufficient to accomplish the above-described result. In addition, valve means 49 includes a third position for maintaining a high pressure in annular recess 28. With this pressure, the pressure forces on control ring 30 due to the pressure difference, if any, between annular recess 28 and diffuser passage 16 is less than the force on control ring 30 due to springs 32, wherein springs 32 maintain the control ring in the full throttling position. Preferably, when valve means 49 is in the third position, conduits 46 and 48 are closed by, respectively, valves 50 and 51 and vapor passes into annular recess 28 from diffuser passage 16 to equalize the vapor pressures therein.

Valves 50 and 51 are operated by positioning means 53, which may be of any appropriate type such as electric, pneumatic, or hydraulic positioners. Positioning means 53 are responsive to an operating condition of the compressor or its associated equipment which is indicative of the load on the compressor. Then, if the compressor were to be used in a refrigeration machine, then the positioning means could be responsive to the temperature of the chilled water leaving the machine, this temperature being related to the quantity of refrigerant being lifted from the low side to the high side of the machine by the compressor. If the compressor were being used to compress air, then the positioning means could be responsive to ambient temperature, since this is an indication of the air density and, therefore, the quantity of air being compressed. Preferably, though, valves 50 and 51 are operated in response to the position of guide vanes 24, sensed by sensing means 55. Sensing means 55 may include, for example, limit switches (not shown) which are actuated by a guide vane or a control linkage thereof in response to movement of the guide vane to predetermined positions, indicating restricted flow through compressor 10.

Compressor 10, with diffuser control 26 described above, functions as follows. With valve means 49 in the first position wherein low pressure conduit 46 is open and intermediate pressure conduit 48 is closed by valve 51, annular recess 28 is in communication with the low pressure source via conduit 46, and the pressure in the recess is approximately equal to that of the low pressure source. Vapor pressure in annular recess 28 is less than vapor pressure in diffuser passage 16 and a pressure difference exists across control ring 30, urging the control ring 30 rearward, to the left as viewed in the drawings. As mentioned above, the low pressure source is chosen so that the forces on control ring 30 resulting from the pressure differential thereacross when valve 50 is open and valve 51 is closed are greater than the forces on the control ring due to springs 32 and 38. Thus, the vapor pressure forces dominate and control ring 30 is moved to and maintained in the open position, allowing maximum vapor flow through diffuser passage 16.

Second stop means 52 may be provided to limit rearward movement of control ring 30, and preferably the second stop means includes a surface of stationary ring 44. More specifically, as control ring 30 moves rearward and reaches the open position, flange 54 of the control ring abuttingly engages surface 52 and this abutting engagement prevents further rearward movement of the control ring. With this arrangement, flange 54 and surface 52, when abuttingly engaged as described above, also function as sealing means for retarding vapor flow from the higher pressure, right side of control ring 30 to the lower pressure, left side thereof.

To move control ring 30 to the intermediate throttling position, shown in FIG. 2, valve means 49 is moved to the second position wherein low pressure conduit 46 is closed by valve 50 and intermediate pressure conduit 48 is open. This may be done, for example, in response to guide vanes 24 moving to a predetermined position wherein vapor flow through compressor 10 is restricted. Annular recess 28 is in communication with the intermediate pressure chamber via conduit 48. The pressure in recess 28 is increased to approximately that of the intermediate pressure source, and the pressure difference across control ring 30 is decreased. As mentioned above, the intermediate pressure source is chosen so that the vapor pressure forces on control ring 30 when valve 50 is closed and valve 51 is open are less than the combined forces on the control ring due to springs 32 and 38. Thus, control ring 30 moves from the open position toward the intermediate throttling position.

When control ring 30 reaches the intermediate throttling position, shown in FIG. 2, movable ring 42 abuttingly engages stationary ring 44, preventing further forward movement of the movable ring and spring 38. Thus, springs 38 do not urge control ring 30 further to the right. Springs 32 continue to urge control ring 30 further to the right. However, also as mentioned above, the intermediate pressure source is chosen so that the vapor pressure forces on control ring 30 resulting from the pressure differential thereacross when valve 50 is closed and valve 51 is open are greater than the forces on the control ring due solely to springs 32. That is, the force due to springs 32 is insufficient to move control ring 30 to the right, springs 38 are prevented by rings 42 and 44 from urging the control ring to the right, and the pressure differential across the control ring is insufficient to move the control ring to the left against the combined forces of springs 32 and 38. As a consequence, control ring 30 is maintained in the intermediate throttling position. In this position, control ring 30 throttles the vapor flowing through diffuser passage 16, providing a stable vapor flow therethrough at the reduced flow rate. Moreover, when control ring 30 is in the intermediate throttling position, movable ring 42 abuttingly engages both stationary ring 44 and fingers 45 of the control ring, and rings 42 and 44 and fingers 45 function as sealing means for retarding vapor flow from the higher pressure, right side of the control ring 30 to the lower pressure, left side thereof.

Figure 3:
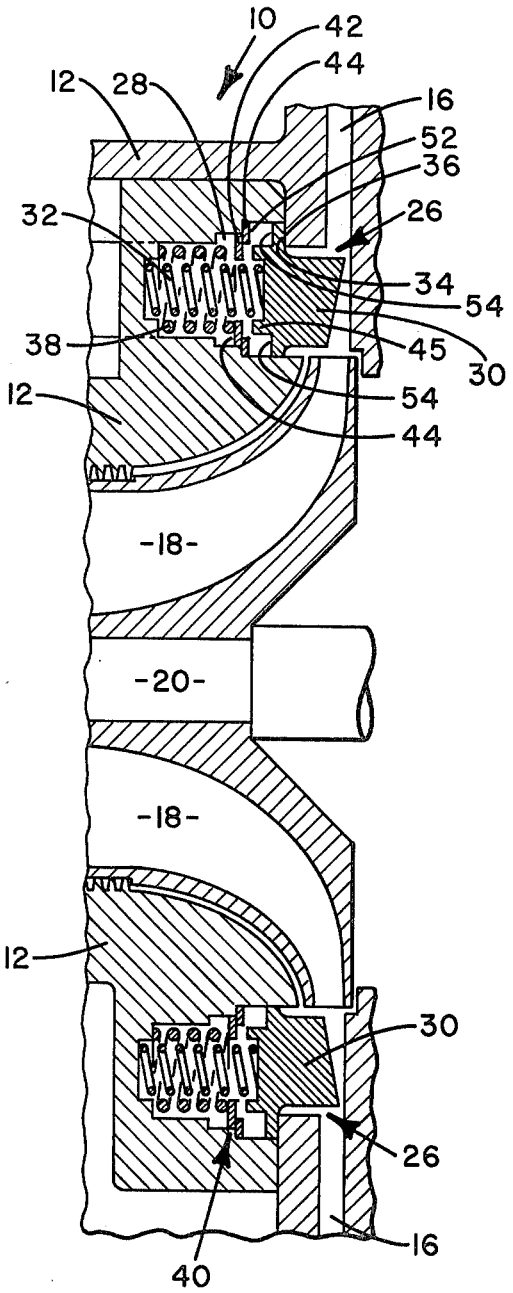
FIG. 3 shows portions of the compressor shown in FIG. 1 with the diffuser control ring in the full throttling position.

To move control ring 30 to the full throttling position, shown in FIG. 3, valve means 49 is moved to the third position wherein low and intermediate pressure conduits 46 and 48 are closed by valves 50 and 51 respectively. This may be done, as an example, in response to guide vanes 24 moving to a second predetermined position further restricting vapor flow through compressor 10. Vapor passes into annular recess 28 from diffuser passage 16 via the interface between fingers 45 and movable rings 42, and vapor pressure in the annular recess and the diffuser passage equalize, equalizing the vapor pressure forces on the control ring. Forces from springs 32 dominate and push control ring 30 into diffuser passage 16 to the full throttling position, wherein abutting contact between flange 36 and surface 34 prevent further forward movement of the control ring. Control ring 30 further throttles vapor passing through diffuser passage 16, maintaining stable vapor flow therethrough even at the further restricted rate of flow through compressor 10.

The three positions of control ring 30 provide stable vapor flow through diffuser passage 16 over a wide range of compressor loads. At the same time, duffuser control 26, since it does not include the complex mechanical of pneumatic components of many prior art diffuser ring controls, is relatively simple to construct and install. This substantially reduces the cost and improves the reliability of the diffuser control, and facilitates manufacture and installation thereof. Furthermore, the simplicity of diffuser control 26, particularly the absence of any complicated mechanical linking arrangement connecting the control with, for example, guide vanes 24, makes the diffuser control well suited for use on a retrofit basis.

While it is apparent that the invention herein disclosed is well calculated to fulfill the objects above stated, it will be appreciated that numerous modifications and embodiments may be devised by those skilled in the arts, and it is intended that the appended claims cover all such modifications and embodiments as fall within the true spirit and scope of the present invention.

What is claimed is:

1. A diffuser control for controlling vapor flow through a diffuser passage comprising:

an annular recess defined by a housing of the passage and in communication therewith;

diffuser restriction means supported for movement within the annular recess and the diffuser passage between a full throttling position, wherein the restriction means throttles vapor flow through the diffuser passage, and an open position for permitting a substantially free flow of vapor through the diffuser passage;

first urging means supported by the housing for urging the diffuser restriction means toward the full throttling position;

first stop means for limiting movement of the restriction means at the full throttling position;

second urging means supported by the housing for urging the diffuser restriction means toward an intermediate throttling position located between the open and full throttling positions;

force limiting means for limiting the force exerted by the second urging means on the diffuser restriction means at the intermediate throttling position;

conduit means for connecting the annular recess to a low pressure source;

first sealing means for retarding vapor flow from a higher pressure side of the diffuser restriction means to a lower pressure side thereof when the restriction means is in the open position;

second sealing means for retarding vapor flow from a higher pressure side of the diffuser restriction means to a lower pressure side thereof when the restriction means is in the intermediate throttling position; and valve means for regulating vapor flow through the conduit means and including a first position for maintaining a low pressure in the annular recess and a first pressure difference across the diffuser restriction means for maintaining the restriction means in the open position, a second position for maintaining an intermediate pressure in the annular recess and a second pressure difference across the diffuser restriction means for maintaining the restriction means in the intermediate throttling position, and a third position for maintaining a high pressure in the annular recess wherein the first urging means maintains the restriction means in the full throttling position.

2. A centrifugal vapor compressor comprising:

a housing defining an inlet passage and a diffuser passage;

an impeller rotatably mounted in the housing between the inlet and diffuser thereof;

an annular recess defined by the housing adjacent the diffuser thereof;

diffuser restriction means supported for movement within the annular recess and the diffuser passage between a full throttling position, wherein the restriction means throttles refrigerant vapor flow through the diffuser passage, and an open position for permitting a substantially free flow of vapor through the diffuser passage;

first urging means supported by the housing for urging the diffuser restriction means toward the full throttling position;

first stop means for limiting movement of the restriction means at the full throttling position;

second urging means supported by the housing for urging the diffuser restriction means toward an intermediate throttling position located between the open and full throttling positions;

force limiting means for limiting the force exerted by the second urging means on the diffuser restriction means at the intermediate throttling position;

conduit means for connecting the annular recess to a low pressure source;

first sealing means for retarding vapor flow from a higher pressure side of the diffuser restriction means to a lower pressure side thereof when the restriction means is in the open position;

second sealing means for retarding vapor flow from a higher pressure side of the diffuser restriction means to a lower pressure side thereof when the restriction means is in the intermediate throttling position; and valve means for regulating vapor flow through the conduit means and including a first position for maintaining a low pressure in the annular recess and a first pressure difference across the diffuser restriction means for maintaining the restriction means in the open position, a second position for maintaining an intermediate pressure in the annular recess and a second pressure difference across the diffuser restriction means for maintaining the restriction means in the intermediate throttling position, and a third position for maintaining a high pressure in the annular recess wherein the first urging means maintains the restriction means in the full throttling position.

3. The invention as defined by claim 1 or 2 wherein the conduit means includes:

a low pressure conduit for connecting the annular recess to the low pressure source; and an intermediate pressure conduit for connecting the annular recess to an intermediate pressure source.

4. The invention as defined by claim 3 further including second stop means for limiting movement of the restriction means at the open position.

5. The invention as defined by claim 4 wherein:

when the valve means is in the first position, the intermediate pressure conduit is closed thereby and the low pressure conduit is open;

when the valve means is in the second position, the low pressure conduit is closed thereby and the intermediate pressure conduit is open; and when the valve means is in the third position, the low and intermediate pressure conduits are closed thereby.

6. The invention as defined by claim 5 wherein the force limiting means includes:

a movable communicating member for transmitting force between the second urging means and the diffuser restriction means as the diffuser restriction means moves between the open and intermediate throttling positions; and third stop means for limiting movement of the communicating member when the diffuser restriction means is at the intermediate throttling position wherein, as the diffuser restriction means moves between the intermediate throttling and full throttling positions, the communicating member is spaced from the diffuser restriction means for preventing force from being transmitted between the second urging means and the diffuser restriction means.

7. The invention as defined by claim 6 wherein the first sealing means includes the second stop means and a surface of the diffuser restriction means.

8. The invention as defined by claim 7 wherein:

the first urging means includes first resilient means positioned within the annular recess; and the second urging means includes second resilient means positioned within the annular recess.

9. The invention as defined by claim 8 wherein:

the communicating member includes a ring slidably supported within the annular recess between the second resilient means and the diffuser restriction means; and the third stop means includes a ring secured to the housing and extending into the annular recess.

10. The invention as defined by claim 9 wherein:

the first resilient means includes a plurality of first springs; and the second resilient means includes a plurality of second springs adjacent to and interposed between first springs.

11. The invention as defined by claim 2 wherein the low pressure source is an inlet line to the compressor.

12. The invention as defined by claim 11 wherein the position of the valve means is determined by the position of an inlet guide vane of the compressor.

* * * * *